United States Patent [19]

Meier

[11] Patent Number: 4,501,213

[45] Date of Patent: Feb. 26, 1985

[54] FEED CONTROL FOR A SEWING MACHINE

[75] Inventor: Willi Meier, Karlsruhe-Durlach, Fed. Rep. of Germany

[73] Assignee: Dorina Nähmaschinen GmbH, Fed. Rep. of Germany

[21] Appl. No.: 531,688

[22] Filed: Sep. 13, 1983

[30] Foreign Application Priority Data

Sep. 18, 1982 [DE] Fed. Rep. of Germany ..... 3234688

[51] Int. Cl.[3] ..... D05B 3/04

[52] U.S. Cl. ..... 112/316; 112/158 E

[58] Field of Search ..... 112/316, 315, 314, 158 E, 112/317

[56] References Cited

U.S. PATENT DOCUMENTS

| | | | |
|---|---|---|---|
| 3,834,334 | 9/1974 | Adams et al. | 112/316 |
| 4,145,982 | 3/1979 | Kume et al. | 112/158 E |
| 4,167,912 | 9/1979 | Sedlatschek et al. | 112/314 X |
| 4,236,469 | 12/1980 | Takenoya et al. | 112/314 |
| 4,404,509 | 9/1983 | Hartwig | 112/158 E |

FOREIGN PATENT DOCUMENTS

| | | | |
|---|---|---|---|
| 2924038 | 12/1979 | Fed. Rep. of Germany | 112/314 |

*Primary Examiner*—Werner H. Schroeder
*Assistant Examiner*—Andrew M. Falik
*Attorney, Agent, or Firm*—McGlew and Tuttle

[57] ABSTRACT

A drive for the work feed mechanism of a sewing machine comprises a stepping motor which is secured to a support connected to the housing of the sewing machine in a manner permitting rotary displacement and whose output shaft is connected to the setting shaft of a control mechanism by which the feed amount and direction of a feed dog is determined. To facilitate the adjustment of the angular step position of the stepping motor, the setting shaft of the control mechanism is mounted coaxially of the axis of displacement of the support of the stepping motor. To obtain a compact construction, the setting shaft of the control mechanism is supported in a bushing which is firmly connected to the support and fitted, but angularly displaceable and secured by clamp, in an open bearing of the sewing machine housing.

7 Claims, 3 Drawing Figures

FEED CONTROL FOR A SEWING MACHINE

FIELD AND BACKGROUND OF THE INVENTION

This invention relates in general to sewing machines and in particular to a new and useful control device for varying the feeding of the work in a sewing machine.

In a prior art arrangement (U.S. Pat. No. 4,145,982), a support firmly connected to the stepping motor is secured by screws to the housing of the sewing machine. The screws extend through arcuate slots in the support which are concentric of the motor axis, so that a correction of the angular position of the control member relative to the angular step position of the stepping motor is made possible. This can be done upon loosening the screws by turning the support coaxially to the motor axis. An accurate correction of the mutual angular position of the control member and the step is complicated in this design. In addition, the transmission play between the motor pinion and the guideway of the control member which is mounted in the housing of the sewing machine may change during the adjustment and result in disturbances in the transmission.

SUMMARY OF THE INVENTION

The invention is directed to an operating connection between the stepping motor and the control mechanism, favorable to and satisfying the work and adjustment.

In accordance with the invention a control device for the work feeding mechanism of a sewing machine which has a support which carries an oscillating mechanism for shifting a feed dog backwardly and forwardly in an amount controlled by a sliding member movable in a guide depending upon the position of the guide and the slide member relative to each other comprises a stepping motor support which includes a drive shaft support bushing having a rotatable setting shaft therein. The stepping motor is mounted on the support and has a rotatable drive shaft drivingly connected to the setting shaft to rotate at a selected amount and it is connected to the guide in order to shift the guide relative to the slide member of the feed mechanism.

The control mechanism is mounted coaxially of the axis of displacement of the support of the stepping motor.

The setting shaft of the control mechanism is advantageously supported in a bearing bushing which is firmly connected to the support and it rotatably fitted in the housing of the sewing machine and is advantageously positioned on the housing by engagement in an open bearing. The arrangement is such that the adjustment transmission play between the motor shaft and the control mechanism may be kept unchanged during a correction of the angular step position of the stepping motor. The arrangement results in a compact construction of the entire assembly. The equipment may be assembled together with the sewing machine and the tolerances set by adjustment of the position of the support rotationally in respect to this open bearing mounting of the support on the sewing machine.

Accordingly, it is an object of the invention to provide an improved device for effecting the control of the feeding of the sewing machine in a simple and easy manner and which includes a stepping motor carried on a separate support which may be easily mounted on a sewing machine and connected to the control mechanism for the feed.

A further object of the invention is to provide a control device for the work feed mechanism of a sewing machine which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
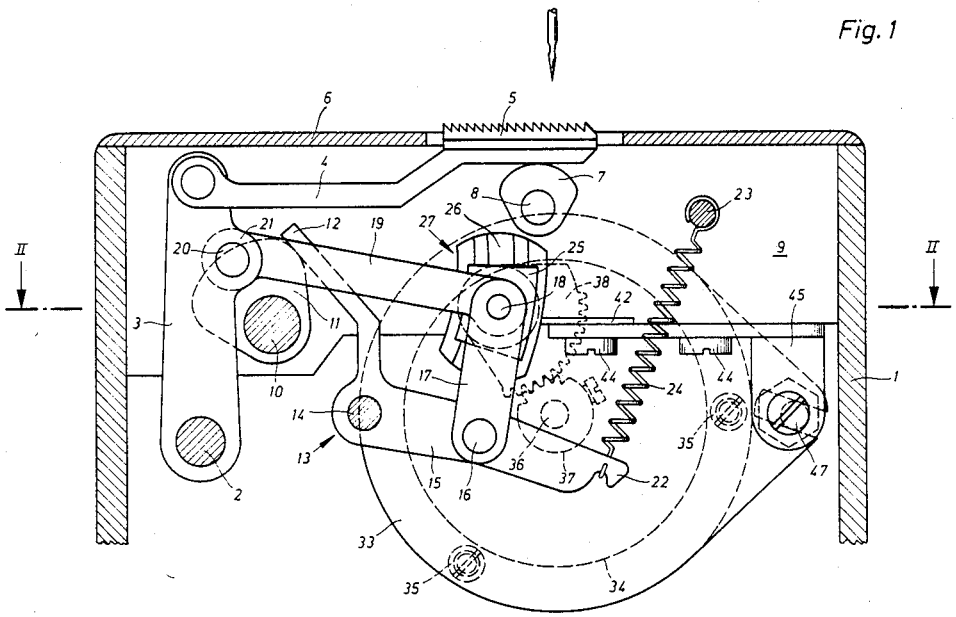
FIG. 1 is a partial sectional view of the lower arm of a sewing machine having a feed control mechanism constructed in accordance with the invention.

Referring to the drawings in particular the invention embodied therein comprises a control device for the work feeding mechanism of a sewing machine which has a support of wall portion 9 carrying an oscillating mechanism for shifting a feed dog 5 backwardly and forwardly. The feed dog 5 is shifted in an amount controlled by a sliding member 25 which moves in a guide 26. The amount of control of the feeding depends upon the position of the guide 26 and the slide member 25 relative to each other. In accordance with the invention, the guide is shifted relative to the sliding member by means of a setting shaft 28 which is operated from a stepping motor 34. The control mechanism is carried on the support 33 and a bushing 31 of the support engages into an open bearing 39 of the wall support 9 of the sewing machine. The bushing 31 contains a pivotal axis of rotation for support 33 on the housing or wall support 9. The position of the bushing is determined by a angled offset portion 41 of the spring 42 which rides in a recess 43 of the bushing 31. The bushing supports a rotatable setting shaft 28 which has a spherical joint 29 which is engageable with the guide 26 to shift its position and vary the feed motion.

In the lower arm 1 (FIG. 1) of the housing of the sewing machine, a shaft 2 is mounted to which a swing lever 3 is secured. Connected to the swing lever 3 is a support 4 for a feed dog 5 which is secured to the free end of support 4 and protrudes through a cover plate 6 of lower arm 1. Feed dog 5 is engaged from below by a lifting eccentric 7 which is secured to a shaft 8 mounted in lower arm 1 and connected to a drive of the sewing machine.

On a housing wall 9 extending transversely to lower arm 1, a shaft 10 is mounted to which an eccentric 11 is secured. Shaft 10 is connected to the drive of the sewing machine in a known manner (not shown). Applied to eccentric 11 is an arm 12 of a double lever 13 which is secured to a pin 14 mounted on housing wall 9. The other arm 15 of double lever 13 is connected through a pin 16 to a link 17. Link 17 is connected through a pin 18 to a connecting bar 19 which is hinged at its other end through a stud 20 to a lug 21 of swing lever 3.

A spring 24 which is attached to a nose 22 of double lever 13 and by its other end it is secured to a bolt 23 secured to the housing wall 9. The spring 24 pulls arm 12 of the double lever 13 against eccentric 11.

Figure 2:
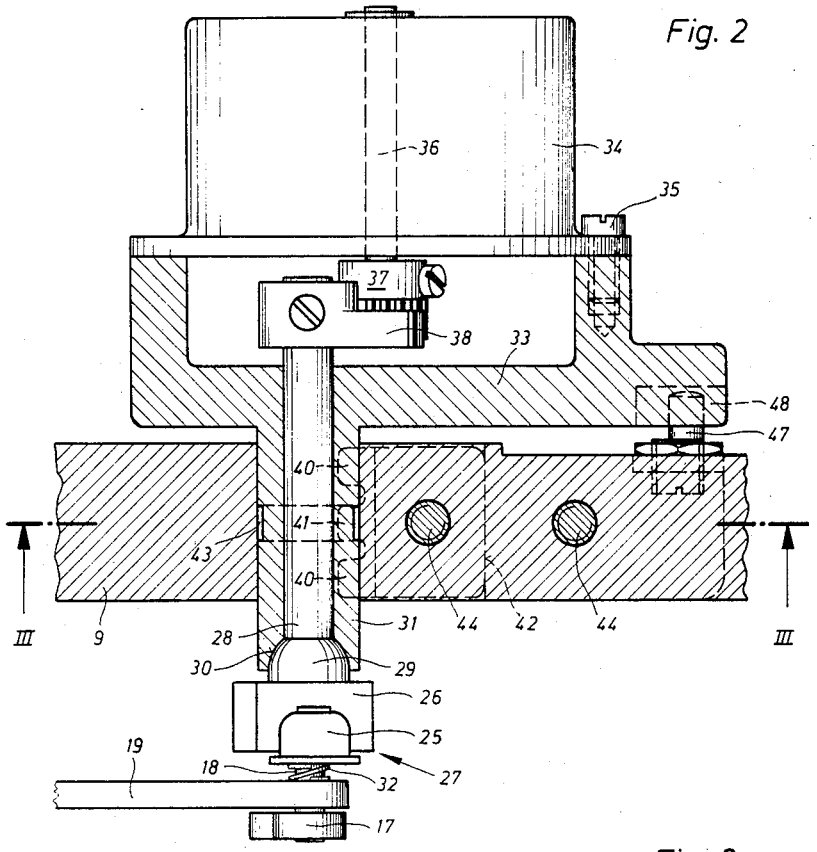
FIG. 2 is a section taken along the lines II—II of FIG. 1.

A sliding member 25 (FIG. 2) is mounted for rotation on the pin 18 and cooperates with a guideway 26. Sliding member 25 and guideway 26 form a control mechanism 27 (FIG. 2). Guideway 26 comprises an arcuate slideway having rounded slide surfaces facing the arcuate center line and cooperating with correspondingly curved slide surfaces of a sliding member 25. Guideway 26 is molded onto the end portion of a setting shaft 28 and is in turn guided through a spherical joint 29 in a correspondingly shaped socket 30 of a bushing 31.

Sliding member 25 is pressed into contact with guideway 26 by a spring 32 which is provided on pin 18 between the member 25 and connecting bar 19.

Figure 3:
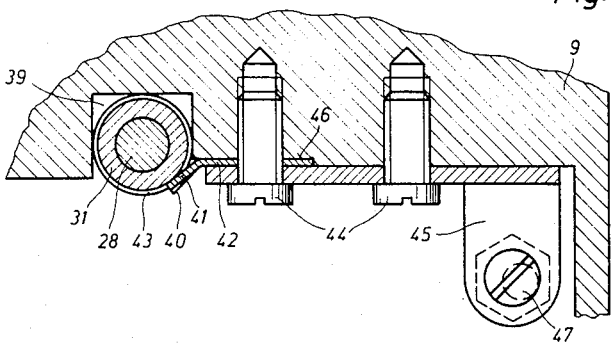
FIG. 3 is a section taken along the lines III—III of FIG. 2.

Bushing 31 forms a part of a support 33 to which a stepping motor 34 is secured by screws 35. The output shaft 36 of stepping motor 34 carries a pinion 37 meshing with a gear segment 38 which is secured to setting shaft 28. Bushing 31 (FIG. 3) is mounted in an open bearing 39 in housing wall 9 and is urged into the bearing by the angled end portions 40,41 of a clamping spring 42. The central angled end portion 41 of clamping spring 42 is bent at a slightly larger angle and engages a recess 43 of bushing 31. This prevents bushing 31 from being displaced axially in bearing 39.

An angle piece 45 secured to housing wall 9 by screws 44 presses clamping spring 42 against a surface 46 milled in wall 9. An eccentric bolt 47 is detachably secured in angle piece 45 and engages a slot 38 in support 33.

During operation of the sewing machine, shaft 10 rotates, so that eccentric 11 through double lever 13 and link 17 connected thereto reciprocates sliding member 25 on the slide surfaces of guideway 26. Corresponding to the angular position of guideway 26 which is set by stepping motor 34 through setting shaft 28, the sliding member 25 imparts oscillatory movements to swing lever 3 through connecting bar 19 and thereby feed movements to feed dog 5, of an extension and direction depending on the angular position of guideway 26.

Lifting eccentric 7 is driven through shaft 8 in synchronism with shaft 10 and imparts lifting movements to feed dog 5.

The compact assembly of the stepping motor drive, inclusive of the supporting elements of guideway 26, is received on support 33 and may be fitted together outside the sewing machine, in a suitable fixture. The required play between the teeth of pinion 37 and gear segment 38 is easy to adjust and check. The initial angular position of guideway 26 also can be adjusted to the predetermined angular step position and to an electronic device (not shown) for determining the initial position of stepping motor 34, as well as checked in the same easy manner.

Upon being assembled and adjusted, the entire assembly is put in place in the sewing machine by engaging sliding member 25 into guideway 26 and eccentric bolt 47 into slot 48 of support 38 and inserting bushing 31 into bearing 39 and clamping with spring 42. After fixing the entire assembly, the adjusted transmission play can no longer change. What is now necessary is only to set the feed zero position by temporarily loosening and turning eccentric bolt 47. This zero position of guideway 26 is the initial position for executing feed steps of equal length of feed dog 5, in both the forward and the rearward direction of sewing.

While a specific embodiment of the invention has been shown and described in detail to illustrate the application of the principles of the invention, it will be understood that the invention may be embodied otherwise without departing from such principles.

What is claimed is:

1. A control device for the work feeding mechanism of a sewing machine having a support carrying an oscillating mechanism for shifting a feed dog backwardly and forwardly in an amount controlled by a sliding member which is movable in a guideway and depending on the position of the guideway and the sliding member relative to each other, comprising a stepping motor support having a drive shaft supporting bushing, a rotatable setting shaft rotatably supported in said bushing, a stepping motor mounted on said stepping motor support and having a rotatable drive shaft drivingly connected to said setting shaft to rotate said setting shaft a selected amount, said setting shaft being connected to one of said sliding member and said guide to adjust the relative positions thereof and vary the feeding mechanism.

2. A control device according to claim 1, wherein said bushing has an annular groove thereon, said sewing machine support including an open bearing in a spring bearing against said bushing having a portion thereof engageable in said annular groove.

3. A control device according to claim 1, wherein said feed mechanism includes a sewing machine driving shaft, an eccentric driven by said driving shaft and a double armed lever oscillated by said eccentric, said oscillating lever driving a bar connected to said feed dog to shift said feed dog laterally and carrying said sliding member.

4. A control device according to claim 1, wherein said setting motor support includes a bushing which is rotable in said sewing machine support, said setting motor support having a slot and an eccentric bolt carried by said sewing machine support being rotably engageable in said slot and permitting shifting of said setting motor support in a rotational direction in respect to said bushing.

5. A control device for the work feed mechanism of a sewing machine having a housing and including a setting shaft of a control mechanism which determines the feed amount and direction of a feed dog, comprising a support mounted on the housing of the sewing machine for rotation about a pivotal axis of said support, a stepping motor secured to said support and having an output shaft drivingly engaged with the setting shaft of the control mechanism to effect its rotation for determining the feed amount and direction of the feed dog, said setting shaft of the control mechanism being mounted coaxially of the pivotal axis of said support.

6. A control device according to claim 5, wherein said setting shaft of said control mechanism is supported in a bearing bushing containing the pivotal axis and which is firmly connected to said sewing machine support and rotatably fitted into the housing of said sewing machine.

7. A control device according to claim 6, wherein said bushing is received in an open bearing secured in place by a clamp.

* * * * *